United States Patent [19]

Peretti et al.

[11] Patent Number: 4,896,845

[45] Date of Patent: Jan. 30, 1990

[54] AIR SUPPORTED STRUCTURE EQUIPMENT PARTICULARLY SUITABLE FOR BALLISTIC TYPE MUNITIONS SUPPLY CONTAINER

[75] Inventors: Claudio Peretti; Guglielmo Rebuffatti, both of Lombardore Turin, Italy

[73] Assignee: A.R.I.S.S.p.A., Turin, Italy

[21] Appl. No.: 228,974

[22] Filed: Aug. 5, 1988

[51] Int. Cl.[4] ..... F42B 15/033

[52] U.S. Cl. ..... 244/3.1; 244/120; 102/384

[58] Field of Search ..... 102/293, 374, 382, 384; 244/3.1, 3.24, 3.27, 3.28, 3.29, 120

[56] References Cited

U.S. PATENT DOCUMENTS 1,448,166 3/1923 Strong ..... 244/3.29
2,314,942 3/1943 Hinchcliff ..... 102/293
2,423,090 7/1947 Fink et al. ..... 102/384
4,447,025 5/1984 Bock et al. ..... 244/3.28

FOREIGN PATENT DOCUMENTS 572568 10/1945 United Kingdom ..... 102/384

*Primary Examiner*—Stephen C. Bentley
*Attorney, Agent, or Firm*—Browdy and Neimark

[57] ABSTRACT

Air carrying equipment particularly suited for ballistic type munitions, consisting of two parts that can be mutually coupled: a saddle that can be mounted to straddle the munition, provided with a pair of wings that are opposite and hinged close to the longitudinal edges of the saddle; and a cradle that can be mounted underneath the body of the munition, which can be coupled to saddle and contains fuel tanks, a motor device in the rear and an ogival part or torpedo nose in front with air intake and wind rotor.

6 Claims, 1 Drawing Sheet

A
B
3
4
4a
5
6
7
7a
8
9
9a
10
11

AIR SUPPORTED STRUCTURE EQUIPMENT PARTICULARLY SUITABLE FOR BALLISTIC TYPE MUNITIONS SUPPLY CONTAINER

BACKGROUND OF THE INVENTION

1. Field of the Invention

The present invention relates to air carrying equipment for ballistic munitions.

2. The Prior Art

The use is known of ballistic munitions transported by carrier aircraft to be released on pre-established targets. It is also known that such munitions, whether they are intended to be used for purposes of war or for transporting various supplies, generally belong to two basic classes: the first (stand-off) includes munitions originally equipped with motor elements and carrying elements which allow the carrier aircraft to release them at a pre-established distance with respect to the target which the munition automatically reaches; the other relates to munitions that originally are prefabricated without said motor element and carrying elements.

Even if the equipment in practice is completed by a plurality of elements, such as: a motor, preferably a rocket motor, a wind-operated electric generator intended to supply electric power both to the on-board unit located in the cradle and to the rocket motor for the ascent, and a hydraulic unit and programmable electronic means, such elements are outside the object of this invention which is defined by the sole carrying or delivery equipment applicable to munitions.

SUMMARY OF THE INVENTION

The main object of the present invention is to provide air carrying means for sustaining flight, that can be rapidly applied to munitions that originally do not have them.

Another object of the invention is to achieve carrying means that can be rapidly applied and/or removed in regard to munitions that do not have them, without altering the structure of the munitions.

The objects set forth above can be attained by use of the equipment in question which consists of two complementary parts: a saddle and a cradle. The saddle, consisting of a substantially cylindrical sector, is mounted straddling the munition, provided with a pair of opposite wings, hinged close to the longitudinal edges of the cylindrical sector. The wings are closed and adjacent to the sides of the unit during flight of the carrier, and open by reaction of compressed elastic means, when the munition is released. Means limiting the dihedral opening angle are provided. The cradle, which can be coupled to the saddle, is mounted underneath the body of the munition and is locked there by rapidly removable means.

BRIEF DESCRIPTION OF THE DRAWINGS

The invention is described below with reference to the accompanying diagrammatic drawings that represent a preferred embodiment of the equipment, in which.

DETAILED DESCRIPTION OF THE INVENTION

Figures 1, 2:
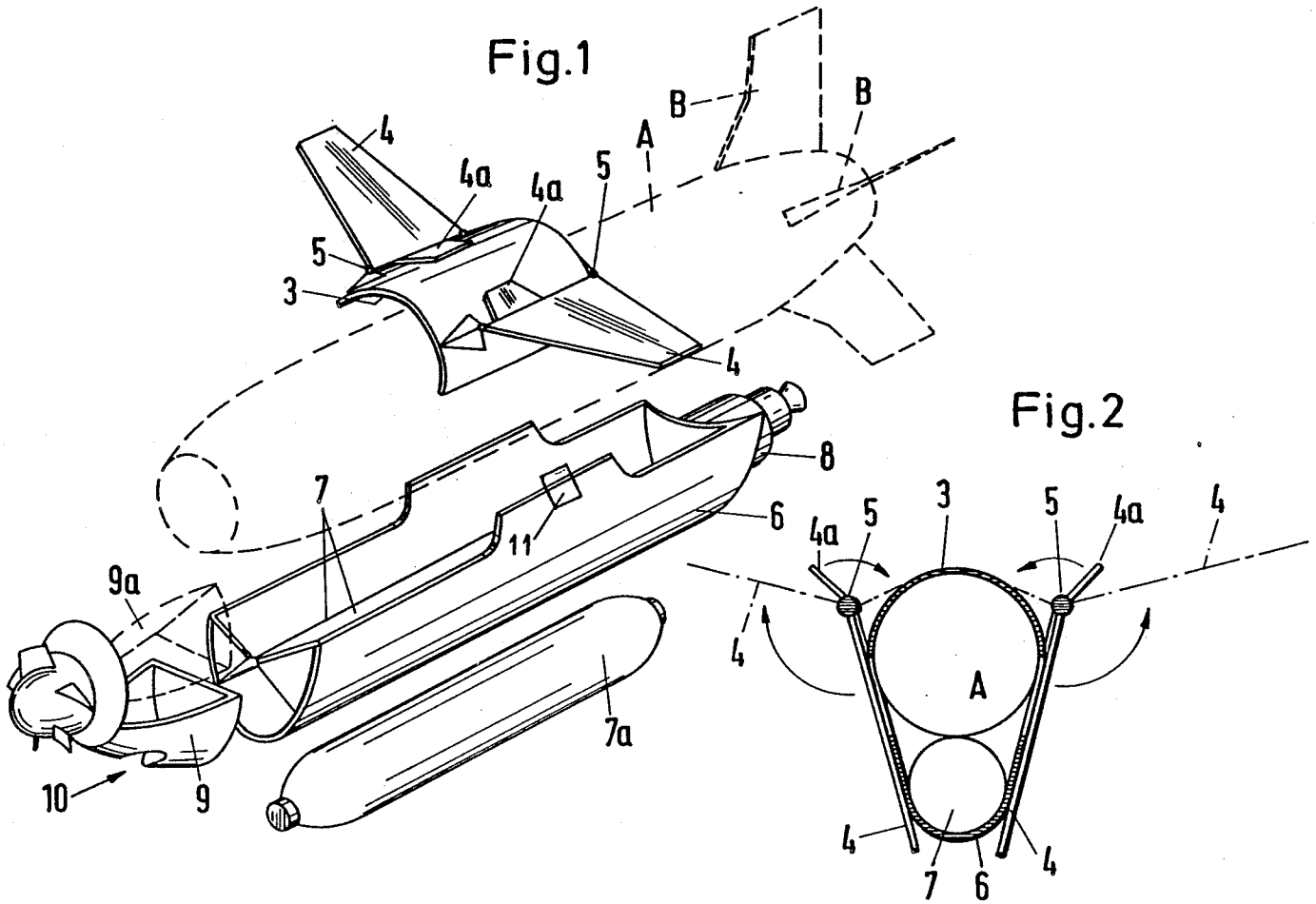
FIG. 1 is an exploded axonometric view of the unit.
FIG. 2 is a view in cross section made along a median vertical plane of FIG. 1.

In the drawings, A indicates in broken lines a prefabricated munition supply container or body, provided with fixed tail units. Saddle 3 is mounted straddling body A, and is provided with a pair of opposite wings 4, hinged at 5 with respect to the longitudinal edges of saddle 3. 4*a* indicates angled longitudinal projections, integral with wings 4 that intervene against the surface of the shell of saddle 3 when wings 4 open and act to limit the dihedral opening angle of the wings. A cradle 6 is provided and carries fuel tanks 7, 7*a*.

During air transport of munition A, wings 4 are closed against the reaction of compressed elastic means, such as cylindrical springs located in correspondence with the hinges, and adhere to the sides of the unit, as shown in solid lines in FIG. 2. When the carrier aircraft releases body A, together with the equipment, the reaction of said elastic means causes opening of small wings 4 which assume the carrying position represented by solid lines in FIG. 1 and broken lines in FIG. 2.

The means for mutual coupling 11 between saddle 3 and cradle 6 are schematically represented in FIG. 1 since they are of any known type that can be rapidly activated and rapidly removed such as: slip hooks; spring snaps; juxtaposed flanges, carried by the facing edges both of the saddle and cradle, with seats for bolts, or other coupling means, provided they are able to withstand the stresses generated by transport and autonomous flight of the munition.

The cradle 6 is equipped at its front end with a torpedo nose 9, 9*a* with an air intake 10, and on the rear with a suitable propulsion element such as a rocket engine 8.

The present invention relate to equipment comprising substantially a pair of bivalve elements, provided with hinged wings, able to be applied, in a removable way, to the bodies of munitions. In general, the invention comprises any other variant and/or improvements that can be derive from the requirements of practical application.

We claim:

1. Air carrying equipment, particularly being added onto ballistic type munitions having a body, comprising:

two complementary parts mutually coupled together to form a bivalve device, comprising a saddle having a cylindrical sector mounted to straddle the munition, and equipped with a pair of symmetrically opposite foldable wings having hinges close to respective edges of the cylindrical sector, and a cradle for carrying fuel tanks and propulsion elements, and mounted in opposite radial position with respect to said saddle, wherein the two parts hold the body of the munition between them.

2. Air carrying device according to claim 1, further comprising an elastic means for biasing said wings, in an inactive state, to adhere to the cylindrical sector of the saddle.

3. Air carrying device according to claim 1, further comprising means for limiting the dihedral opening angle of the wing opening comprising angled solid projections on said wings which, when the munition is released by a carrier aircraft and the wings are opened at the hinges, intervene against the cylindrical sector of said saddle to limit the opening angle of the wings.

4. Air carrying device according to claim 1, wherein said cradle comprises ogival elements in a first portion provided with an air intake and a suitable seat in a second portion for a propulsion element.

5. Air carrying device according to claim 1, further comprising means for mutual coupling placed between said saddle and said cradle for coupling said saddle and said cradle.

6. Air carrying device according to claim 5, wherein said means for coupling comprise elements which can be rapidly activated and rapidly removed.

* * * * *